US005120626A

United States Patent [19]

Fukuda et al.

[11] Patent Number: 5,120,626

[45] Date of Patent: Jun. 9, 1992

[54] ELECTROPHOTOGRAPHIC PHOTORECEPTOR HAVING AN ANODIZED AL-MG OR AL-MN ALLOY SUBSTRATE AND PROCESS FOR PRODUCING THE SAME

[75] Inventors: Yuzuru Fukuda; Shigeru Yagi, both of Kanagawa; Ken Ebihara, Shizuoka; Yasunobu Iwata, Tokyo, all of Japan

[73] Assignees: Fuji Xerox Co., Ltd.; Nippon Light Metal Co., Ltd.; Nikkei Techno-Research Co., Ltd., all of Tokyo, Japan

[21] Appl. No.: 586,083

[22] Filed: Sep. 21, 1990

[30] Foreign Application Priority Data

Sep. 25, 1989 [JP] Japan ..... 1-246502

[51] Int. Cl.[5] ..... G03G 5/04

[52] U.S. Cl. ..... 430/58; 430/63; 430/84

[58] Field of Search ..... 430/58, 278, 302, 62, 430/63; 428/652

[56] References Cited

U.S. PATENT DOCUMENTS 3,891,516 6/1975 Chu ..... 430/302
4,369,242 1/1989 Arimilli et al. ..... 430/58
4,970,116 11/1990 Kimura et al. ..... 430/278

*Primary Examiner*—John Goodrow
*Attorney, Agent, or Firm*—Finnegan, Henderson, Farabow, Garrett and Dunner

[57] ABSTRACT

An electrophotographic photoreceptor is disclosed, comprising at least a substrate having thereon a charge transporting layer and a charge generating layer, wherein the charge transporting layer is a porous anodized film which is formed by anodizing a substrate comprising an Al-Mg alloy containing from 2.2 to 5.6% by weight of magnesium and, as impurities, at least one of Mn, Cu, Fe, Si, Cr, and Zn or an Al-Mn alloy containing from 1.0 to 1.5% by weight of manganese and, as impurities, at least one of Cu, Fe, Si, and Zn. And the electrophotographic photoreceptor can be produced by a process comprising subjecting a substrate comprising an Al-Mg alloy containing from 2.2 to 5.6% by weight of magnesium and, as impurities, at least one of Mn, Cu, Fe, Si, Cr, and Zn or an Al-Mn alloy containing from 1.0 to 1.5% by weight of manganese and, as impurities, at least one of Cu, Fe, Si, and Zn to anodic oxidation to form a charge transporting layer comprising a porous anodized film and then forming a charge generating layer on the charge transporting layer. The electrophotographic photoreceptor exhibits excellent physical properties and electrophotographic properties, and satisfactory adhesion between a charge transporting layer and a charge generating layer.

6 Claims, 1 Drawing Sheet

ELECTROPHOTOGRAPHIC PHOTORECEPTOR HAVING AN ANODIZED AL-MG OR AL-MN ALLOY SUBSTRATE AND PROCESS FOR PRODUCING THE SAME

FIELD OF THE INVENTION

This invention relates to an electrophotographic photoreceptor and a process for producing the photoreceptor. More particularly, it relates to an electrophotographic photoreceptor having a function separated type photosensitive layer and to a process for producing the photoreceptor.

BACKGROUND OF THE INVENTION

A so-called function separated type electrophotographic photoreceptor has a photosensitive layer composed of a charge generating layer capable of generating a charge carrier on light irradiation and a charge transporting layer into which the thus generated charge carrier can be efficiently introduced and which is capable of efficiently moving the thus generated charge carrier. In recent years, an amorphous silicon type electrophotographic photoreceptor having a charge generating layer made of amorphous silicon and a charge transporting layer made of an amorphous material which is formed by a plasma CVD method has been attracting attention because it has a possibility of basically improving charging properties and productivity of conventional amorphous silicon type electrophotographic photoreceptors without impairing excellent characteristics possessed by amorphous silicon, such as photosensitivity, high hardness, and heat stability and is therefore promising for obtaining electrical stability on repeated use and a long working life. Attention being paid on these aspects, amorphous silicon type electrophotographic photoreceptors using various charge transporting layers have been proposed. For example, a charge transporting layer which can be used in such an amorphous silicon type electrophotographic photoreceptor of separate function type includes a layer comprising silicon oxide or amorphous carbon formed by a plasma CVD method as disclosed, e.g., in U.S. Pat. No. 4,634,648.

In the above-described amorphous silicon type electrophotographic photoreceptor of separate function type, improvement in chargeability and reduction in dark decay can be brought about by using amorphous silicon as a charge generating layer and using, as a charge transporting layer, a substance having a smaller dielectric constant and higher resistance than the amorphous silicon. However, since a film formed by the above-mentioned plasma CVD method has the same rate of film formation as an amorphous type film and also has a complicated layer structure, the probability of film defects increases to reduce productivity of a photoreceptor, resulting in an extreme increase of production cost.

SUMMARY OF THE INVENTION

Accordingly, an object of this invention is to provide an electrophotographic photoreceptor having an improved charge transporting layer.

That is, one object of the present invention is to provide an electrophotographic photoreceptor having high durability in which a charge transporting layer has high mechanical strength or hardness, and reduced film defects.

Another object of the present invention is to provide an electrophotographic photoreceptor which has high sensitivity, excellent panchromatic property, high chargeability, reduced dark decay, and reduced residual potential after exposure to light.

A further object of the present invention is to provide an electrophotographic photoreceptor whose charging characteristics are not affected by environmental changes.

A still further object of the present invention is to provide an electrophotographic photoreceptor which provides an image with excellent quality even on repeated use.

A yet further object of the present invention is to provide a process for producing the above-described electrophotographic photoreceptor.

The inventors previously found that an oxide of aluminum has a function as a charge transporting layer. As a result of further investigations, it has now been discovered that a porous aluminum oxide film which is obtained from an aluminum alloy having a specific composition shows further improvements in physical characteristics, electrophotographic characteristics, and adhesion to a charge generating layer. The present invention has been completed based on this finding.

The present invention relates to an electrophotographic photoreceptor comprising at least a substrate having thereon a charge transporting layer and a charge generating layer, wherein said charge transporting layer is a porous anodized film which is formed by anodizing a substrate comprising an Al-Mg alloy containing from 2.2 to 5.6% by weight of magnesium and, as impurities, at least one of Mn, Cu, Fe, Si, Cr, and Zn or an Al-Mn alloy containing from 1.0 to 1.5% by weight of manganese and, as impurities, at least one of Cu, Fe, Si, and Zn.

The electrophotographic photoreceptor of the present invention can be produced by a process comprising subjecting a substrate comprising an Al-Mg alloy containing from 2.2 to 5.6% by weight of magnesium and, as impurities, at least one of Mn, Cu, Fe, Si, Cr, and Zn or an Al-Mn alloy containing from 1.0 to 1.5% by weight of manganese and, as impurities, at least one of Cu, Fe, Si, and Zn to anodic oxidation to form a charge transporting layer comprising a porous anodized film and then forming a charge generating layer on the charge transporting layer.

BRIEF DESCRIPTION OF THE DRAWING

FIGURE illustrates a schematic cross section of an embodiment of the electrophotographic photoreceptor according to the present invention.

DETAILED DESCRIPTION OF THE INVENTION

Figure 1:
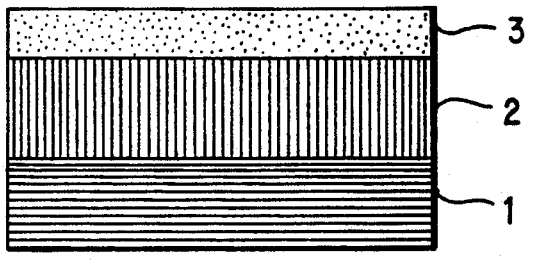

FIGURE is a schematic cross section of the electrophotographic photoreceptor according to the present invention which comprises substrate 1, e.g., a pipe having a diameter of from 30 to 200 mm, porous anodized film 2 formed on substrate 1, and charge generating layer 3 formed on film 2.

The substrate which can be used in the present invention includes an Al-Mg alloy containing from 2.2 to 5.6% by weight of magnesium and, as impurities, at least one of Mn, Cu, Fe, Si, Cr, and Zn and an Al-Mn alloy containing from 1.0 to 1.5% by weight of manganese and, as impurities, at least one of Cu, Fe, Si, and Zn. The Mg content in the Al-Mg alloy is in the range of from 2.2 to 5.6% by weight (preferably from 2.5 to 4.5% by weight) in order to obtain a desired strength of a substrate. The impurity elements other than Al and Mg preferably comprise not more than 0.40% by weight (particularly from 0.01 to 0.2% by weight) of Si, not more than 0.40% by weight (particularly from 0.01 to 0.3% by weight) of Fe, not more than 0.10% by weight (particularly from 0.01 to 0.07% by weight) of Cu, not more than 1.0% by weight (particularly from 0.01 to 0.8% by weight) of Mn, from 0.05 to 0.35% by weight (particularly from 0.05% to 0.25% by weight) of Cr, and not more than 0.25% by weight (particularly from 0.01 to 0.25% by weight) of Zn. Further, Ti may be contained as the impurity element in an amount of from 0 to 0.2% by weight. The Mn content in the Al-Mn alloy is in the range of from 1.0 to 1.5% by weight in order to obtain a desired strength of a substrate. The impurity elements other than Al and Mn preferably comprise not more than 0.6% by weight (particularly from 0.01 to 0.4% by weight) of Si, not more than 0.7% by weight (particularly from 0.01 to 0.65% by weight) of Fe, not more than 0.20% by weight (particularly from 0.01 to 0.2% by weight) of Cu, and not more than 0.10% by weight (particularly from 0.01 to 0.1% by weight) of Zn. In each of the Al-Mg alloy and Al-Mn alloy, if the impurity content is out of the above-recited respective range, charge transporting properties or image quality would be reduced. In particular, if the impurity concentration exceeds the respective upper limit, the resulting porous anodized film tends to suffer from defects.

Specific examples of these aluminum alloys include alloy Nos. 5052, 5154, 5454, 5056, and 5083 as described in JIS H 4080 for the Al-Mg alloy; and alloy Nos. 3003 and 3203 as described in the same standard for the Al-Mn alloy. In the present invention, the Al-Mg alloy is preferred as the substrate and particularly alloy No. 5056 is preferred.

The porous anodized film formed on the surface of the substrate plays a role as a charge transporting layer. The porous anodized film is formed on the above-described substrate by anodic oxidation as follows. A substrate with an aluminum surface having been polished to have a mirror finish and cut to a desired size is subjected to ultrasonic cleaning in an organic solvent or a flon (i.e., Freon) solvent and then in pure water.

An electrolytic solution is filled in an electrolytic cell made of stainless steel, hard glass, etc. to a prescribed level. The electrolytic solution which can be used for forming the porous anodized film is usually a 1 to 30% by weight (preferably from 5 to 25% by weight) acid aqueous solution of at least one inorganic polyproton acid selected from the group consisting of sulfuric acid, phosphoric acid, chromic acid, etc. or at least one organic polyproton acid selected from the group consisting of oxalic acid, malonic acid, tartaric acid, etc. Among these inorganic or organic polyproton acids, sulfuric acid, phosphoric acid and oxalic acid are preferred. Pure water to be used as a solvent includes distilled water and ion-exchanged water. In order to prevent corrosion of the anodized film or production of pinholes, it is particularly preferred to remove impurities,.e.g., chlorine, from water.

Then, the substrate, e.g., an aluminum alloy pipe (i.e., a cylindrical substrate), and a stainless steel plate or an aluminum plate are immersed in the electrolytic solution as an anode and a cathode, respectively, with a given electrode gap therebetween. The electrode gap is appropriately selected from 0.1 to 100 cm. Where direct current electrolysis is conducted, a direct current power source is prepared, and its positive (plus) terminal is connected to the cylindrical substrate and the negative (minus) terminal to the cathode plate, and electricity is passed through the both electrodes in the electrolytic solution. Electrolysis is carried out by a constant current method or a constant voltage method. The direct current applied may consist solely of a direct current component or may comprise a combination of a direct current and an alternating current. A current density in carrying out anodic oxidation is set usually between 0.1 $A \cdot dm^{-2}$ and 10 $A \cdot dm^{-2}$ and preferably between 0.1 $A \cdot dm^{-2}$ and 6 $A \cdot dm^{-2}$. Taking the rate of film formation and cooling efficiency into consideration, a current density of from 0.5 to 3.0 $A \cdot dm^{-2}$ is particularly preferred. An anodizing voltage usually ranges from 3 to 150 V, and preferably from 7 to 100 V. The electrolytic solution has a temperature of usually from −5° to 100° C. and preferably from 0° to 80° C.

Where alternating current electrolysis is carried out, an alternating current power source is prepared, each terminal of the power source is connected to the respective electrode, and an alternating voltage is applied to pass electricity between the electrodes. The alternating current to be passed is a commercial alternating current having an effective voltage of usually from 3 to 40 V, and preferably from 8 to 15 V, or an electric current of alternating waveform having the same action. The temperature of the electrolytic solution is set within a range of usually from −5° to 40° C., and preferably from 5° to 30° C.

If desired, the thus formed porous anodized film may be washed with pure water, followed by drying. The porous anodized film has a thickness of usually from 1 to 100 μm, and preferably from 5 to 50 μm, and further preferably has a mean pore size of from 2 to 90 nm and a porosity of from 10 to 50%.

If desired, the porous anodized film may further be subjected to secondary electrolysis to fill a metal in the pores thereof. The metal filled in the pores contributes to charge transporting property as a conductor to improve charge transporting ability of the charge transporting layer. The metal to be filled preferably includes Fe, Ni, Co, Sn, Cu, Zn, and a mixture of two or more thereof. Among these, Ni and Co are preferred.

Filling of the metal into pores can be carried out through adsorption, deposition or precipitation of a metal(s) in the pores by immersion, .electrolysis, or any other appropriate technique, for example, by electrodeposition (i.e., precipitation due to electrolysis).

Electrolysis is preferably carried out in a solution containing a sulfate of said metal at a liquid temperature of from 5° to 30° C. by using an alternating voltage of from 10 to 40 V.

On the thus prepared porous anodized film, a charge generating layer is directly formed with intimate contact. A charge generating layer includes a layer of an inorganic substance, e.g., amorphous silicon, selenium, selenium hydride, and selenium-tellurium, formed by plasma CVD, vacuum evaporation, sputtering or the like technique. Additionally included in a charge generating layer is a layer formed by vacuum evaporation of a dye, e.g., phthalocyanine, copper phthalocyanine, Al-phthalocyanine, squaric acid derivatives, and bisazo dyes, or by dip coating of a dispersion of such a dye in a resin. Inter alia, a charge generating layer formed of amorphous silicon or germanium-doped amorphous silicon exhibits excellent mechanical and electrical characteristics.

A case where a charge generating layer is formed by using amorphous silicon is instanced in illustration.

A charge generating layer mainly comprising amorphous silicon can be formed by a process appropriately selected according to the purpose from among known techniques, such as glow discharge decomposition, sputtering, ion plating, and vacuum evaporation. Glow discharge decomposition of silane or a silane type gas by a plasma CVD method is preferred. According to the plasma CVD method, a film containing an adequate amount of hydrogen which has relatively high dark resistance and high photosensitivity and thus exhibits favorable characteristics as a charge generating layer can be formed.

A plasma CVD method will be illustrated below.

Raw materials for forming an amorphous silicon photosensitive layer mainly comprising silicon include silanes, e.g., monosilane and disilane. If desired, a carrier gas, e.g., hydrogen, helium, argon, and neon, may be used in the formation of a charge generating layer. These starting gases may be doped with diborane ($B_2H_6$), phosphine ($PH_3$), etc. to form a layer containing an impurity element, e.g., boron, phosphorus, etc. For the purpose of increasing photosensitivity, etc., the photosensitive layer may further contain a halogen atom, a carbon atom, an oxygen atom, a nitrogen atom, etc. For the purpose of increasing sensitivity to a longer wavelength region, the layer may furthermore contain germanium, tin, etc.

The charge generating layer which can be preferably used in the present invention mainly comprises silicon and contains from 1 to 40 atom%, and particularly from 5 to 20 atom%, of hydrogen. The thickness of the charge generating layer is in the range of usually from 0.1 to 30 μm, and preferably of from 0.2 to 5 μm.

Conditions of forming a charge generating layer are usually from 0 to 5 GHz, preferably from 3 to 5 GHz, in frequency; usually from $1\times10^{-5}$ to 5 Torr (0.001 to 665 Pa), preferably from $1\times10^{-1}$ to 3 Torr in degree of vacuum on discharging; and usually from 100° to 400° C., preferably from 150° to 300° C. in substrate heating temperature.

If desired, the electrophotographic photoreceptor of the present invention may have a surface protective layer for preventing alteration due to corona ion.

The present invention is now illustrated in greater detail with reference to Examples, but it should be understood that the present invention is not limited thereto.

EXAMPLE 1

A cylindrical aluminum pipe (diameter: about 120 mm) made of an Al-Mg alloy comprising 0.07 wt% of Si, 0.11 wt% of Fe, 5.0 wt% of Mg, 0.13 wt% of Mn, 0.13 wt% of Cu, and Al as the remainder (corresponding to JIS alloy No. 5056) was immersed in an aqueous solution containing 50 g/l of a degreasing agent ("Fine Cleaner 315" produced by Nihon Parkerizing Co., Ltd.) at 55° C. for 3 minutes, followed by washing with water.

Subsequently, the aluminum alloy pipe was subjected to anodic oxidation in an aqueous solution containing 150 g/l of $H_2SO_4$ and 30 g/l of $Al_2(SO_4)_3\cdot14\text{–}18H_2O$ kept at 15° C. by applying an alternating voltage having an effective value of 12 V via a transformer between the pipe (i.e., the cylindrical aluminum pipe) and an aluminum cathode for 95 minutes to form a 12 μm thick porous anodized film.

The pipe with the anodized film thereon was subjected to ultrasonic cleaning in distilled water, followed by drying at 80° C., and placed in a vacuum chamber of a capacitively-coupled type plasma CVD apparatus. The aluminum pipe being maintained at 250° C., 100 wt% silane gas ($SiH_4$), hydrogendiluted 100 ppm diborane gas ($B_2H_6$), and 100 wt% hydrogen gas ($H_2$) were introduced therein at a rate of 250 ml/min, 3 ml/min, and 250 ml/min, respectively. After the inner pressure of the vacuum chamber was set at 1.5 Torr (200.0 $N/m^2$), a high-frequency electric power of 13.56 MHz was applied to cause glow discharge, and the output of the high-frequency power source was maintained at 350 W. There was thus formed a 2 μm thick charge generating layer comprising so-called i-type amorphous silicon, containing hydrogen and a trace amount of boron, and having high dark resistance to obtain an electrophotographic photoreceptor.

Positive chargeability of the resulting photoreceptor was measured. When an electric current of 10 μA/cm was passed through the photoreceptor, the initial surface potential immediately after charging was 520 V, and the dark decay rate was 12%/sec. The residual potential after exposure to white light was 130 V, and the half-decay exposure amount (i.e., exposure required for the half decay of the surface potential) was 8 $erg\cdot cm^{-2}$.

The resulting electrophotographic photoreceptor was mounted on a copying machine ("FX 5990" manufactured by Fuji Xerox Co., Ltd.), and copying was carried out. No white spots were observed in the unexposed black image. The image obtained after the exposure to light was free from non-uniform background fog, proving that charge introduction had been effected uniformly.

COMPARATIVE EXAMPLE 1

An electrophotographic photoreceptor was prepared in the same manner as in Example 1, except that the substrate made of the Al-Mg alloy was replaced with a substrate made of an Al-Mg alloy comprising Al having a purity of 99.99% as a base and 4.25 wt% of Mg.

The resulting photoreceptor was evaluated in the same manner as in Example 1. As a result, white spots appeared on the unexposed black image. Further, the image obtained after exposure to light suffered from non-uniform background fog, proving that charge introduction had not been effected uniformly.

COMPARATIVE EXAMPLE 2

An electrophotographic photoreceptor was prepared in the same manner as in Example 1, except that the substrate made of the Al-Mg alloy was replaced with a substrate made of pure aluminum having a purity of 99.99%.

The resulting photoreceptor was evaluated in the same manner as in Example 1. As a result, white spots appeared on the unexposed black image. Further, the image obtained after exposure to light suffered from non-uniform background fog, proving that charge introduction had not been effected uniformly.

EXAMPLE 2

An electrophotographic photoreceptor was prepared in the same manner as in Example 1, except that the substrate made of the Al-Mg alloy was replaced with a substrate made of an Al-Mn alloy comprising 0.10 wt% of Si, 0.40 wt% of Fe, 1.21 wt% of Mn, 0.13 wt% of Cu, and Al as the remainder (corresponding to JIS alloy No. 3003).

The resulting photoreceptor was evaluated in the same manner as in Example 1. As a result, no white spots were observed in the unexposed black image. The image obtained after the exposure to light was free from non-uniform background fog, proving that charge introduction had been effected uniformly.

COMPARATIVE EXAMPLE 3

An electrophotographic photoreceptor was prepared in the same manner as in Example 2, except that the substrate made of the Al-Mn alloy was replaced with a substrate made of an Al-Mn alloy comprising Al having a purity of 99.99% as a base and 0.8 wt% of Mn.

The resulting photoreceptor was evaluated in the same manner as in Example 1. As a result, a number of white spots appeared on the unexposed black image. Further, the image obtained after exposure to light suffered from non-uniform background fog, proving that charge introduction had not been effected uniformly.

As described above, since the charge transporting layer of the electrophotographic photoreceptor according to the present invention comprises a porous anodized film obtained from an aluminum alloy having a specific composition, charge introduction can be uniformly conducted. Hence, there appear no image defects, such as white spots on an unexposed black image. Further, the image after light exposure is free from non-uniform background fog. In addition, the electrophotographic photoreceptor of the present invention exhibits high sensitivity, excellent panchromaticity, high chargeability, reduced dark decay, and reduced residual potential after exposure to light. The charging characteristics of the photoreceptor are not affected by environmental changes, and an image having excellent quality can be obtained even on repeated running. Also, the photoreceptor has very excellent adhesion between the charge transporting layer and charge generating layer, and high mechanical strength or hardness with reduced defects and thus exhibits excellent durability.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising at least a substrate having thereon a charge transporting layer and a charge generating layer, wherein said charge transporting layer is a porous anodized film which is formed by anodizing a substrate comprising an Al-Mg alloy containing from 2.2 to 5.6% by weight of magnesium and, as impurities, at least one of Mn, Cu, Fe, Si, Cr, and Zn or an Al-Mn alloy containing from 1.0 to 1.5% by weight of manganese and, as impurities, at least one of Cu, Fe, Si, and Zn.

2. A process for producing an electrophotographic photoreceptor comprising subjecting a substrate comprising an Al-Mg alloy containing from 2.2 to 5.6% by weight of magnesium and, as impurities, at least one of Mn, Cu, Fe, Si, Cr, and Zn or an Al-Mn alloy containing from 1.0 to 1.5% by weight of manganese and, as impurities, at least one of Cu, Fe, Si, and Zn to anodic oxidation to form a charge transporting layer comprising a porous anodized film and then forming a charge generating layer on the charge transporting layer.

3. The electrophotographic photoreceptor as claimed in claim 1, wherein said charge generating layer is formed by using amorphous silicon.

4. The process for producing an electrophotographic photoreceptor as claimed in claim 2, wherein said charge generating layer is formed by using amorphous silicon.

5. The electrophotographic photoreceptor as claimed in claim 1, wherein said Al-Mg alloy contains from 2.5 to 4.5% by weight of magnesium.

6. The process for producing an electrophotographic photoreceptor as claimed in claim 2, wherein said Al-Mg alloy contains from 2.5 to 4.5% by weight of magnesium.

* * * * *